US010840592B2

(12) United States Patent
Wu et al.

(10) Patent No.: US 10,840,592 B2
(45) Date of Patent: Nov. 17, 2020

(54) ELECTRONIC DEVICE AND ANTENNA ASSEMBLY THEREOF

(71) Applicant: PEGATRON CORPORATION, Taipei (TW)

(72) Inventors: Chien-Yi Wu, Taipei (TW); Chao-Hsu Wu, Taipei (TW); Shih-Keng Huang, Taipei (TW); Ya-Jyun Li, Taipei (TW); Ching-Hsiang Ko, Taipei (TW); Chun-Chih Chen, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 91 days.

(21) Appl. No.: 16/275,762

(22) Filed: Feb. 14, 2019

(65) Prior Publication Data

US 2019/0296431 A1 Sep. 26, 2019

(30) Foreign Application Priority Data

Mar. 23, 2018 (TW) ..... 107109938 A

(51) Int. Cl.
*H01Q 1/52* (2006.01)
*H01Q 5/335* (2015.01)
(Continued)

(52) U.S. Cl.
CPC ..... *H01Q 1/523* (2013.01); *H01Q 1/2266* (2013.01); *H01Q 1/48* (2013.01); *H01Q 5/335* (2015.01); *H01Q 25/005* (2013.01)

(58) Field of Classification Search
None
See application file for complete search history.

(56) References Cited

U.S. PATENT DOCUMENTS 6,809,690 B2 10/2004 Tao
6,977,613 B2 * 12/2005 He et al. ..... H01Q 9/0407 343/700 MS
(Continued)

FOREIGN PATENT DOCUMENTS

TW M250188 11/2004
TW 200843205 11/2008
(Continued)

OTHER PUBLICATIONS

"Office Action of Taiwan Counterpart Application," dated Jul. 9, 2019, p. 1-p. 5.

*Primary Examiner* — Amy Cohen Johnson
*Assistant Examiner* — James H Cho
(74) *Attorney, Agent, or Firm* — J.C. Patents

(57) ABSTRACT

An electronic device and its antenna assembly are provided. The electronic device includes a display screen, a metal foothold, a motherboard, and an antenna assembly. The display screen and the motherboard are disposed at two opposite surfaces of the metal foothold. The antenna assembly electrically connected to the motherboard includes a metal frame, a plastic sheet, an antenna, and a conductive sheet. The metal frame is disposed at the metal foothold, and one side of the metal frame has an opening, so that the plastic sheet can be embedded in the opening. The antenna includes an antenna main board disposed at the plastic sheet and a double-sided antenna disposed at two opposite sides of the antenna main board. The conductive sheet is connected to the double-sided antenna and lapped over the metal frame.

20 Claims, 10 Drawing Sheets

(51) Int. Cl.

| | |
|---|---|
| ***H01Q 1/48*** | (2006.01) |
| ***H01Q 1/22*** | (2006.01) |
| ***H01Q 25/00*** | (2006.01) |

(56) References Cited

U.S. PATENT DOCUMENTS

| | | | | |
|---|---|---|---|---|
| 7,339,535 | B2 * | 3/2008 | Liang et al. ..... | H01Q 1/242<br>343/700 MS |
| 7,589,680 | B2 | 9/2009 | Tsai et al. | |
| 10,056,696 | B2 | 8/2018 | Tseng et al. | |
| 10,074,899 | B2 * | 9/2018 | Wu et al. ..... | H01Q 9/42 |
| 2003/0090469 | A1 | 5/2003 | Tao | |
| 2003/0174092 | A1 * | 9/2003 | Sullivan et al. ..... | H01Q 5/335<br>343/702 |
| 2008/0258992 | A1 | 10/2008 | Tsai et al. | |
| 2014/0078010 | A1 * | 3/2014 | Li et al. ..... | H01Q 21/28<br>343/729 |
| 2017/0207542 | A1 | 7/2017 | Tseng et al. | |

FOREIGN PATENT DOCUMENTS

| | | |
|---|---|---|
| TW | M405060 | 6/2011 |
| TW | M537316 | 2/2017 |

* cited by examiner

ELECTRONIC DEVICE AND ANTENNA ASSEMBLY THEREOF

CROSS-REFERENCE TO RELATED APPLICATION

This application claims the priority benefit of Taiwan application serial no. 107109938, filed on Mar. 23, 2018. The entirety of the above-mentioned patent application is hereby incorporated by reference herein and made a part of this specification.

TECHNICAL FIELD

The disclosure relates to an electronic device, and particularly to an electronic device with good communication quality.

DESCRIPTION OF RELATED ART

With the development of communication technologies, electronic devices usually have wireless communication functions, and some electronic devices even cover long-range wireless communication ranges. For instance, mobile phones adopt 2G, 3G, and long term evolution (LTE) systems which perform communications with use of 700 MHz, 850 MHz, 900 MHz, 1800 MHz, 1900 MHz, 2100 MHz, 2300 MHz, and 2500 MHz frequency bands, while some electronic devices cover short-range wireless communication ranges, such as WiFi and Bluetooth systems using 2.4 GHz, 5.2 GHz, and 5.8 GHz frequency bands.

Antennas are indispensable elements serving to support the wireless communications of the electronic devices. The antennas, however, are apt to be affected by neighboring metal elements, which leads to pattern or signal transmission interferences. When a relative position of the antenna and the metal element is changed, the pattern is often changed, or the signal transmission is interfered, such that the overall communication quality is diminished.

SUMMARY

The disclosure provides an electronic device and an antenna assembly whose structures are different from conventional structures.

In an embodiment, an electronic device, including a display screen, a metal foothold, a motherboard, and an antenna assembly is provided. The display screen and the motherboard are disposed at two opposite surfaces of the metal foothold. The antenna assembly is disposed at the metal foothold and electrically connected to the motherboard, wherein the antenna assembly includes a metal frame, a plastic sheet, at least one antenna, and a conductive sheet. The metal frame is disposed at the metal foothold, and at least one side of the metal frame includes an opening, so that the plastic sheet can be embedded in the opening. The antenna includes an antenna main board and a double-sided antenna, wherein the antenna main board is disposed at the plastic sheet and includes a first surface, a second surface, and a conductive hole. The double-sided antenna includes a first antenna pattern and a second antenna pattern, wherein the first antenna pattern is disposed at the first surface of the antenna main board, the second antenna pattern is disposed at the second surface of the antenna main board, the second antenna pattern includes a feed end and a ground end, and a signal transmitted through the feed end is conducted to the first antenna pattern through the conductive hole. The conductive sheet is connected to the ground end and lapped over the metal frame.

In an embodiment, an antenna assembly including a metal frame, a plastic sheet, at least one antenna, and a conductive sheet is provided. At least one side of the metal frame includes an opening, so that the plastic sheet can be embedded in the opening. The antenna includes an antenna main board and a double-sided antenna, wherein the antenna main board is disposed at the plastic sheet and has a first surface, a second surface, and a conductive hole. The double-sided antenna includes a first antenna pattern and a second antenna pattern, wherein the first antenna pattern is disposed at the first surface of the antenna main board, the second antenna pattern is disposed at the second surface of the antenna main board, the second antenna pattern includes a feed end and a ground end, and a signal transmitted through the feed end and the first antenna pattern are conducted through the conductive hole. The conductive sheet is connected to the ground end and lapped over the metal frame.

In view of the above, in the electronic device and the antenna assembly thereof as provided in one or more embodiments, the structure of the antenna assembly is different from the conventional antenna with patterns on one side. Besides, the antenna assembly is disposed at the metal foothold, and the structure of the conventional electronic device (with the antenna assembly installed at the display screen of the conventional electronic device) is different from the structure of the electronic device provided herein.

To make the above features and advantages provided in one or more of the embodiments of the disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles described herein.

DESCRIPTION OF THE EMBODIMENTS

First Embodiment

Figure 1:
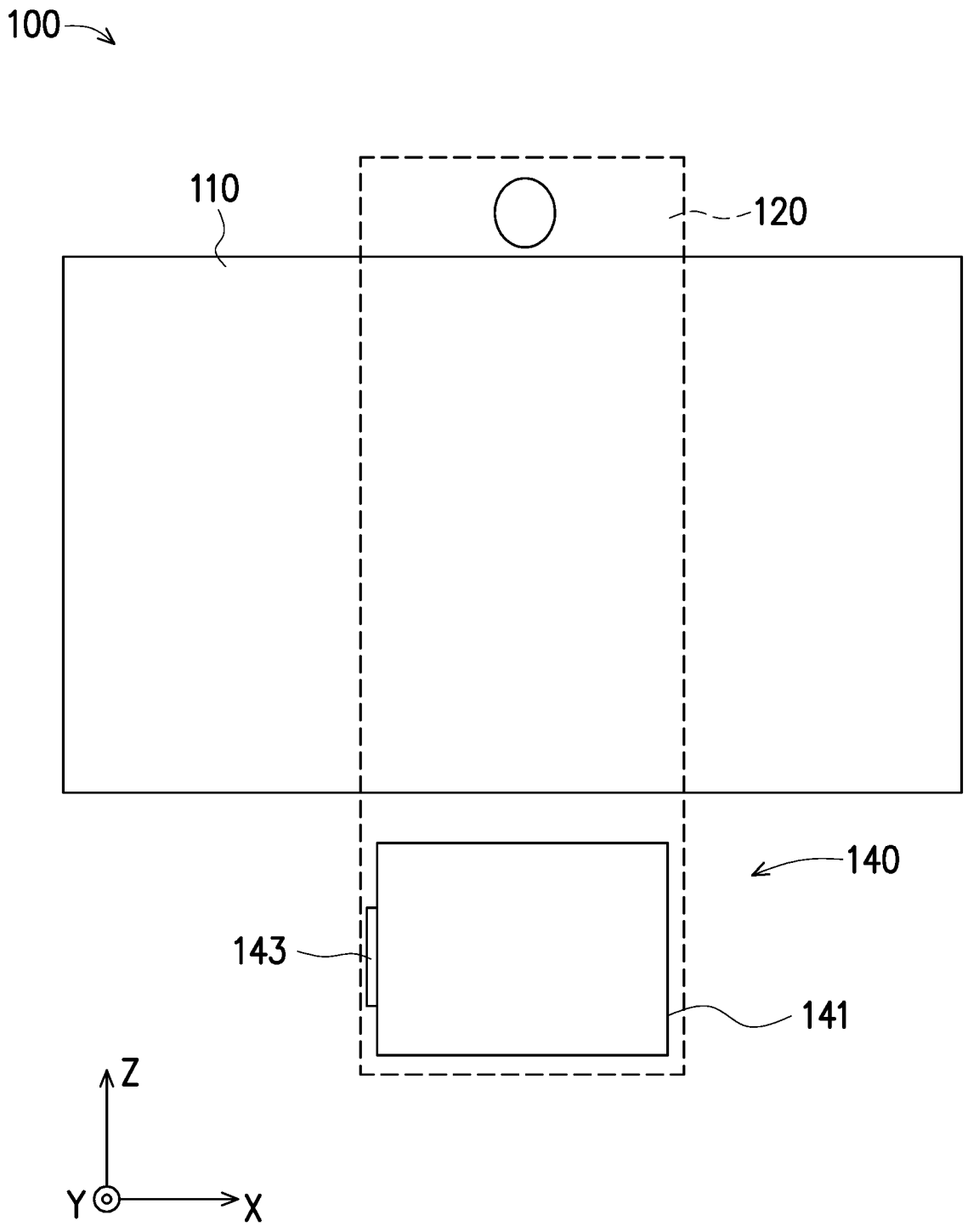
FIG. 1 is a schematic front view of an electronic device according to a first embodiment of the disclosure.
Figure 2:
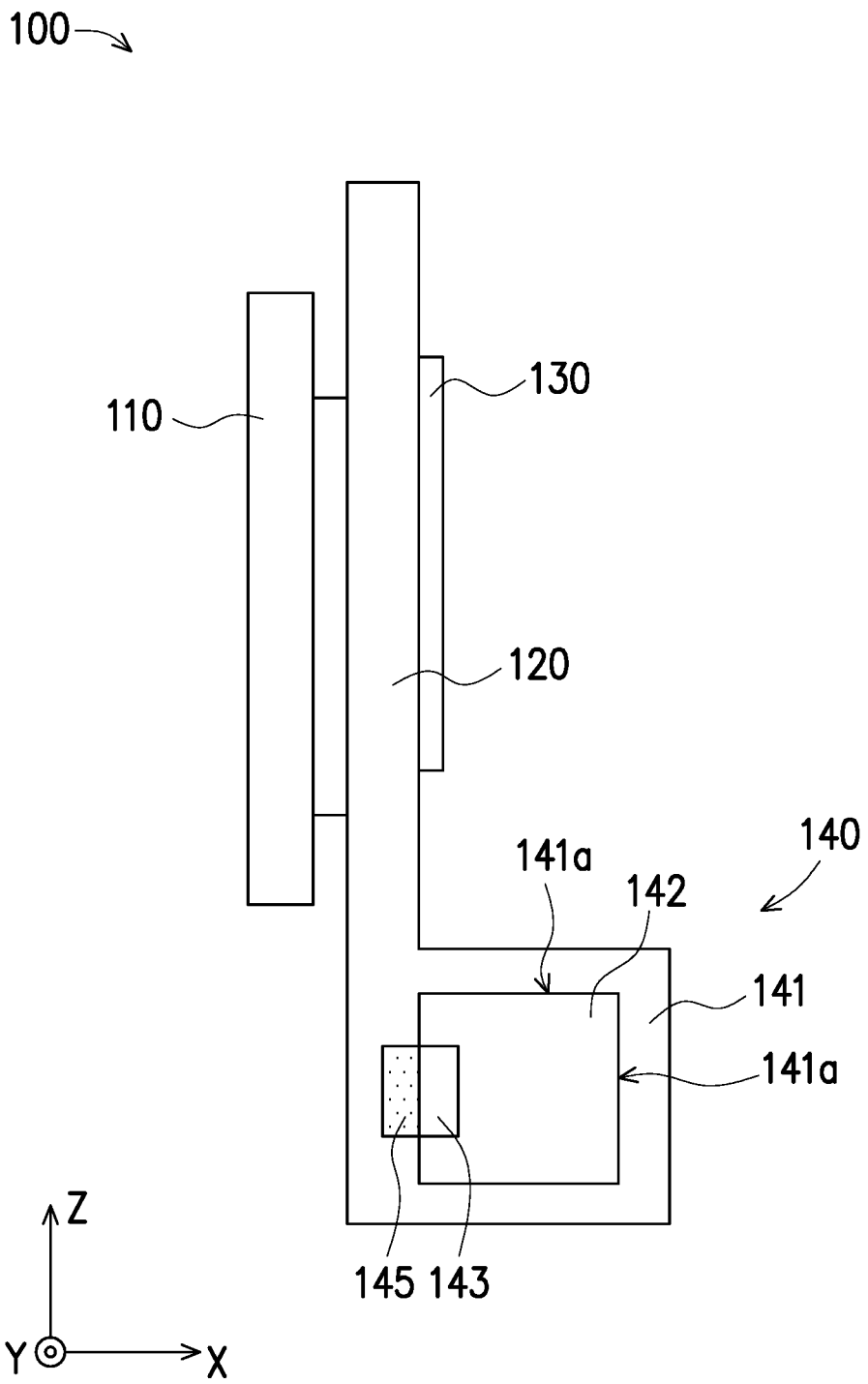
FIG. 2 is a schematic side view of the electronic device depicted in FIG. 1.

FIG. 1 is a schematic front view of an electronic device according to a first embodiment of the disclosure, and FIG. 2 is a schematic side view of the electronic device depicted in FIG. 1. With reference to FIG. 1 and FIG. 2, an electronic device 100 includes a display screen 110, a metal foothold 120, a motherboard 130, and an antenna assembly 140. The display screen 110 and the motherboard 130 are disposed at two opposite surfaces of the metal foothold 120. The antenna assembly 140 is disposed at the metal foothold 120 and electrically connected to the motherboard 130. According to the present embodiment, the electronic device 100 may be but is not limited to an all-in-one (AIO) computer.

Figure 3A:
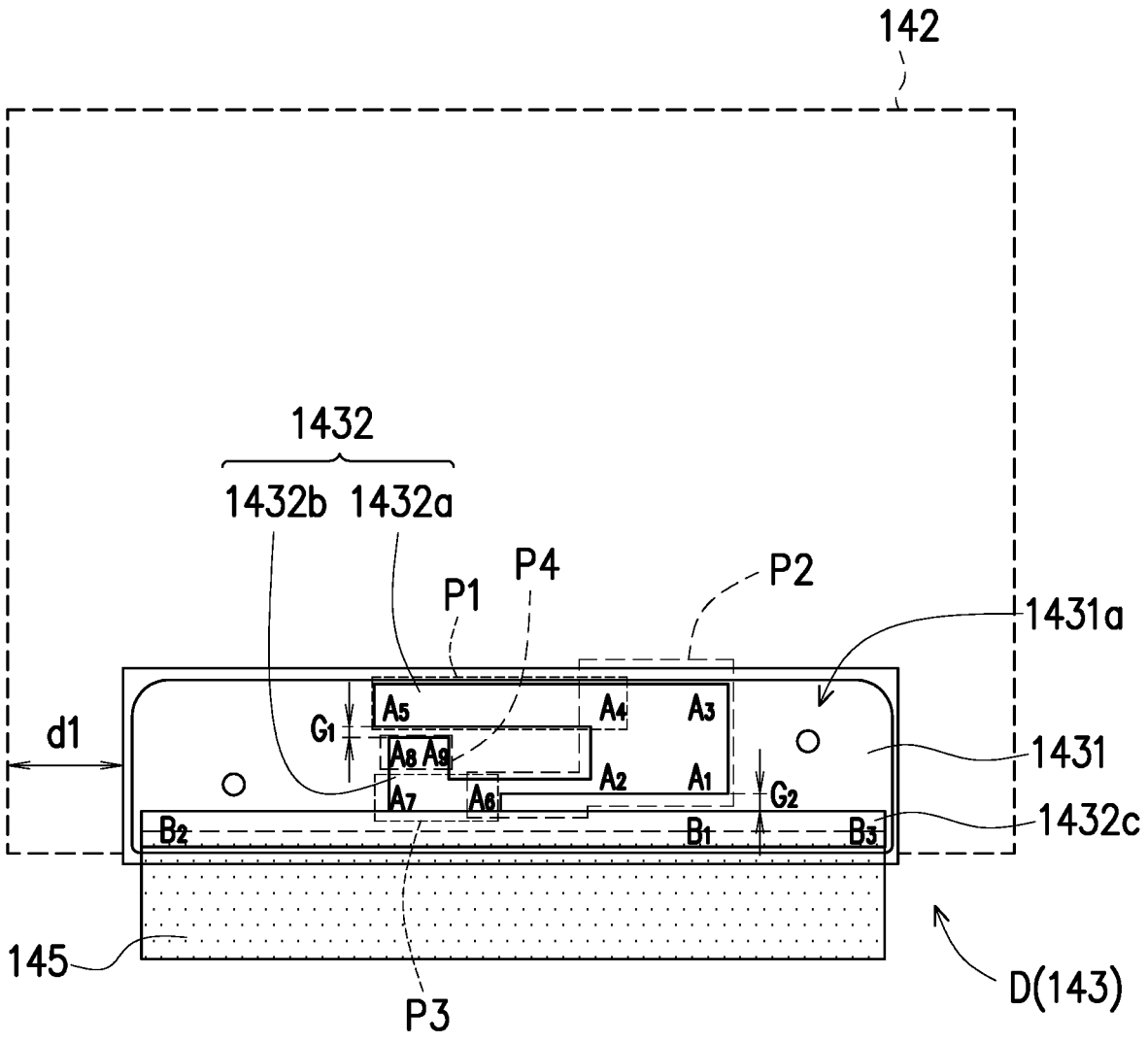
FIG. 3A is a schematic view illustrating an antenna disposed at a plastic sheet.
Figure 3B:
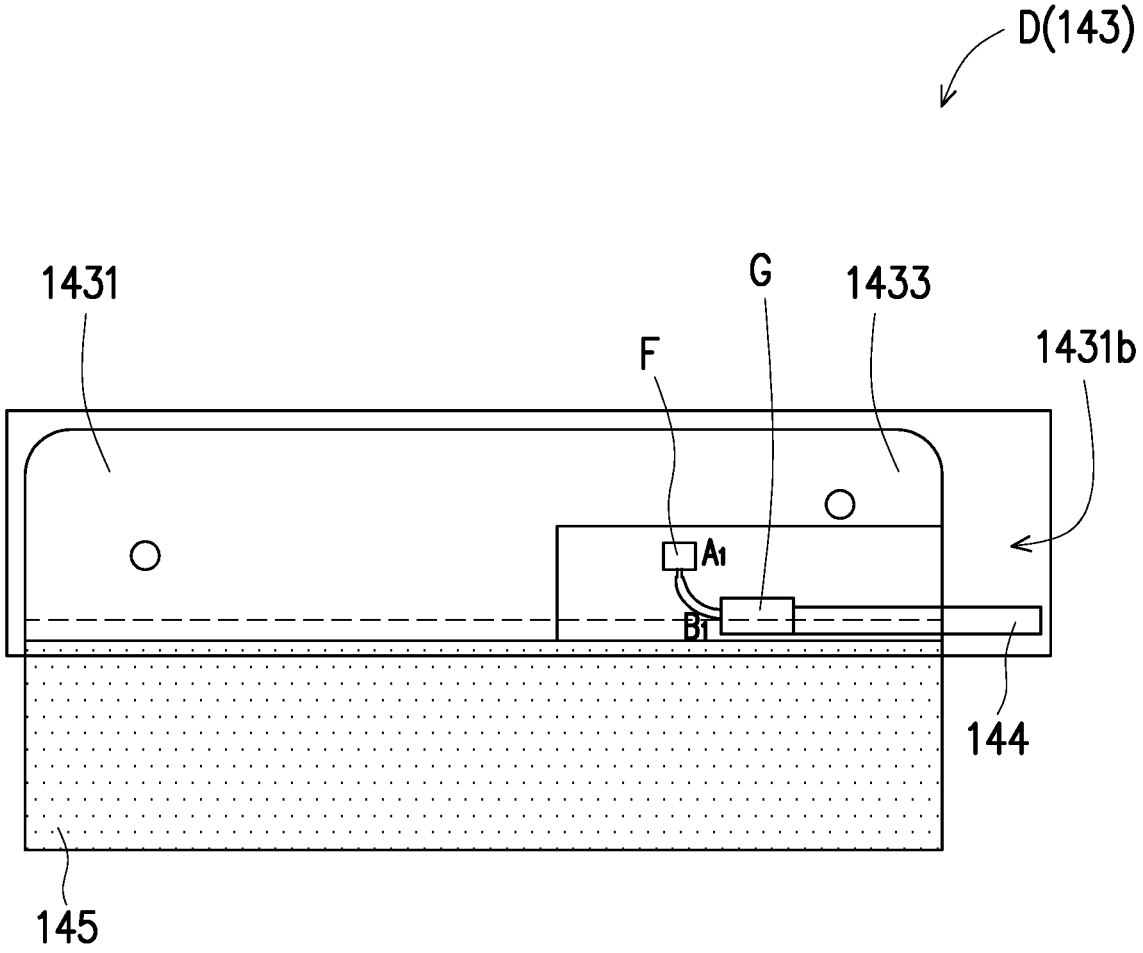
FIG. 3B is a schematic view illustrating another side of the antenna depicted in FIG. 3A.

FIG. 3A is a schematic view illustrating an antenna disposed at a plastic sheet, and FIG. 3B is a schematic view illustrating another side of the antenna depicted in FIG. 3A. With reference to FIG. 2, FIG. 3A, and FIG. 3B, the antenna assembly 140 includes a metal frame 141, a plastic sheet 142, an antenna 143, a coaxial transmission line 144, and a conductive sheet 145. The metal frame 141 is disposed at the metal foothold 120, for example the metal frame 141 is disposed under the metal foothold 120. The metal foothold 120 and the metal frame 141 are integrally formed in terms of structure. That is, the metal foothold 120 and the metal frame 141 are made of the same metal element. In other embodiments, the metal foothold 120 and the metal frame 141 may be independent from each other.

At least one side of the metal frame 141 includes an opening 141*a*, so that the plastic sheet 142 can be embedded in the opening 141*a*. The antenna 143 includes an antenna main board 1431 and a double-sided antenna D. The antenna main board 1431 is disposed at the plastic sheet 142, and the double-sided antenna D is formed at the antenna main board 1431. The double-sided antenna D herein includes two antenna patterns respectively formed at two opposite surfaces of the antenna main board 1431, so that the antenna patterns disposed at the two opposite surfaces of the antenna main board 1431 are electrically coupled to perform functions of the antenna.

The antenna main board 1431 is attached to the plastic sheet 142 embedded in the opening 141*a* of the metal frame 141, and the antenna 143 is located at a center of one side of the plastic sheet 142. The antenna main board 1431 is spaced from the left side and the right side of the plastic sheet 142 by a distance dl, respectively, and the distance dl may be 10 mm, as shown in FIG. 3A.

The description of the orientation in the disclosure is based on the content and reference points depicted in the drawings. It should be known to those skilled in the art that the description of the orientation will be changed with the change of the reference points. For instance, as shown in FIG. 2, the distance between the antenna main board 1431 and the upper side of the plastic sheet 142 may be 10 mm, and the distance between the antenna main board 1431 and the lower side of the plastic sheet 142 may be 10 mm as well.

To be specific, the double-sided antenna D has a first antenna pattern 1432 and a second antenna pattern 1433. The first antenna pattern 1432 is disposed at a first surface 1431*a* of the antenna main board 1431, and the second antenna pattern 1433 is disposed at a second surface 1431*b* of the antenna main board 1431. The first antenna pattern 1432 and the second antenna pattern 1433 are conducted through the conductive hole (a region covered by a feed end F of the second antenna pattern 1433 in FIG. 3B, not shown), and the conductive hole passes through the first surface 1431*a* and the second surface 1431*b* of the antenna main board 1431.

To be specific, the first antenna pattern 1432 has a first radiation portion 1432*a* and a second radiation portion 1432*b* connected to each other, and there is a coupling gap (i.e., a first groove G1) between the first radiation portion 1432*a* and the second radiation portion 1432*b*, and the width of the first groove G1 may be 0.7 mm. The first radiation portion 1432*a* includes a first portion P1 and a second portion P2 connected to each other, and the second radiation portion 1432*b* includes a third portion P3 and a fourth portion P4 connected to each other. The first groove G1 is located between the first portion P1 of the first radiation portion 1432*a* and the fourth portion P4 of the second radiation portion 1432*b*.

In particular, the first portion P1 is a region between a point A4 and a point A5, the second portion P2 is constituted by a region surrounded by a point A1, a point A2, a point A3, and the point A4 and a region between the point A2 and a point A6. The first portion P1 and parts of the second portion P2 (i.e., the region between the point A2 and the point A6) extend toward the same direction, so that the first radiation portion 1432*a* appears to be shaped as a letter U. The third portion P3 is connected to one end of the second portion P2. The third portion P3 is a region between the point A6 and a point A7, and the fourth portion P4 is adjacent to the third portion P3. The fourth portion P4 is a region between a point A8 and a point A9, and thus the second radiation portion 1432*b* appears to be shaped as a letter L.

Besides, the first antenna pattern 1432 further has a third radiation portion 1432*c*, wherein there is a coupling gap (i.e., a second groove G2) between the second portion P2 and the third radiation portion 1432*c* of the first radiation portion 1432*a*, and the width of the second groove G2 may be 1 mm. Particularly, the third radiation portion 1432*c* is a region between a point B3 and a point B2. Besides, the second portion P2 of the second radiation portion 1432*b* is connected to the third radiation portion 1432*c* and connected to the metal frame 141 of the metal foothold 120 through the conductive sheet 145 in a lap joint manner, wherein the conductive sheet 145 is lapped over the metal frame 141. In the present embodiment, the size of the conductive sheet 145 may be 44 mm×15 mm.

The coaxial transmission line 144 is disposed at the second surface 1431*b* of the antenna main board 1431 and electrically connected to the second antenna pattern 1433. The conductive sheet 145 is connected to the metal frame 141 in a lap joint manner and electrically connected to a negative signal end (not shown) of the coaxial transmission line 144. The conductive sheet 145 provided in the present embodiment may be an aluminum foil but is not limited thereto, and the conductive sheet 145 may also be another metal sheet for transmitting signals.

In view of the above, the second antenna pattern 1433 has the feed end F and a ground end G. The feed end F corresponds to the conductive hole (not shown), a positive signal end (not shown) of the coaxial transmission line 144 is electrically connected to the second antenna pattern 1433 through the feed end F, and the conductive sheet 145 is connected to the ground end G in a lap joint manner. In the present embodiment, the conductive hole is at the feed end F and the ground end G. The feed end F corresponds to the point A1 of the first radiation portion 1432*a*, and the ground end G corresponds to the point B1 of the third radiation portion 1432*c*.

Under the structure of the antenna 143, the double-sided antenna D is connected to the positive signal end (not shown) of the coaxial transmission line 144 through the feed end F of the second antenna pattern 1433, and the conductive sheet 145 and the metal frame 141 are conducted. When the coaxial transmission line 144 transmits an electric signal to the second antenna pattern 1433 of the double-sided antenna D through the positive signal end, the electric signal is further transmitted to the first antenna pattern 1432 through the conductive hole (not shown), so that the first radiation portion 1432*a*, the second radiation portion 1432*b*, and the metal frame 141 are resonated to generate a first antenna frequency band, i.e., the antenna frequency band of WiFi 2.4G. In detail, a path constituted by the point A4, the point A3, the point A1, the point A2, the point A6, and the point A7 and a path constituted by the point A6, the point A7, the point A8, and the point A9 are resonated to generate the antenna frequency band of the WiFi 2.4G.

The impedance matching bandwidth of the antenna frequency band of WiFi 2.4G can be controlled or adjusted by adjusting the size of the first groove G1 between the first radiation portion 1432*a* and the second radiation portion 1432*b*. Besides, when the width of the second portion P2 of the first radiation portion 1432*a* (i.e., the length of the path constituted by the point A4 and the point A2) or the length of the first portion P1 of the first radiation portion 1432*a* is adjusted, a resonance frequency of the antenna frequency band of WiFi 2.4G can be re-located.

In light of the foregoing, under the excitation of the feed end F, the second portion P2 of the first radiation portion 1432*a*, the third portion P3 of the second radiation portion 1432*b*, and the metal frame 141 are resonated to generate a second antenna frequency band, i.e., a first antenna frequency band (approximately 5150 MHz to 5500 MHz) of WiFi 5G. When the width of the second portion P2 of the first radiation portion 1432*a* is adjusted (i.e., the length of the path between the point A3 and the point A1), a resonance frequency of the first antenna frequency band of WiFi 5G can be re-located.

Besides, under the excitation of the feed end F, the second portion P2 of the first radiation portion 1432*a*, the third portion P3 of the second radiation portion 1432*b*, the third radiation portion 1432*c*, and the metal frame 141 are resonated to generate a third antenna frequency band, i.e., a second antenna frequency band (approximately 5500 MHz to 6000 MHz) of WiFi 5G. The impedance matching bandwidth of the second antenna frequency band of WiFi 5G can be controlled or adjusted by adjusting the size of the second portion P2 of the first radiation portion 1432*a* and the second groove G2 of the third radiation portion 1432*c*. Besides, when the width of the third portion P3 of the second radiation portion 1432*b* is adjusted, the resonance frequency of the second antenna frequency band of WiFi 5G can be re-located.

As provided above, the antenna assembly 140 provided in the present embodiment has a structure of an open-window antenna assembly having a metal foothold and two grooves. In the electronic device 100 provided in the present embodiment, the antenna assembly 140 and the metal foothold 120 are integrated; hence, compared to the antenna assembly of the conventional electronic device disposed at the display screen, the antenna assembly of the electronic device 100 provided in the present embodiment has a different configuration and structure, and thus the display screen has extra spaces for other applications.

Additionally, the antenna assembly 140 can be an individual element, and the location where the antenna assembly 140 is combined with other elements of the electronic device 100 can be adjusted according to actual demands.

Second Embodiment

Figure 4:
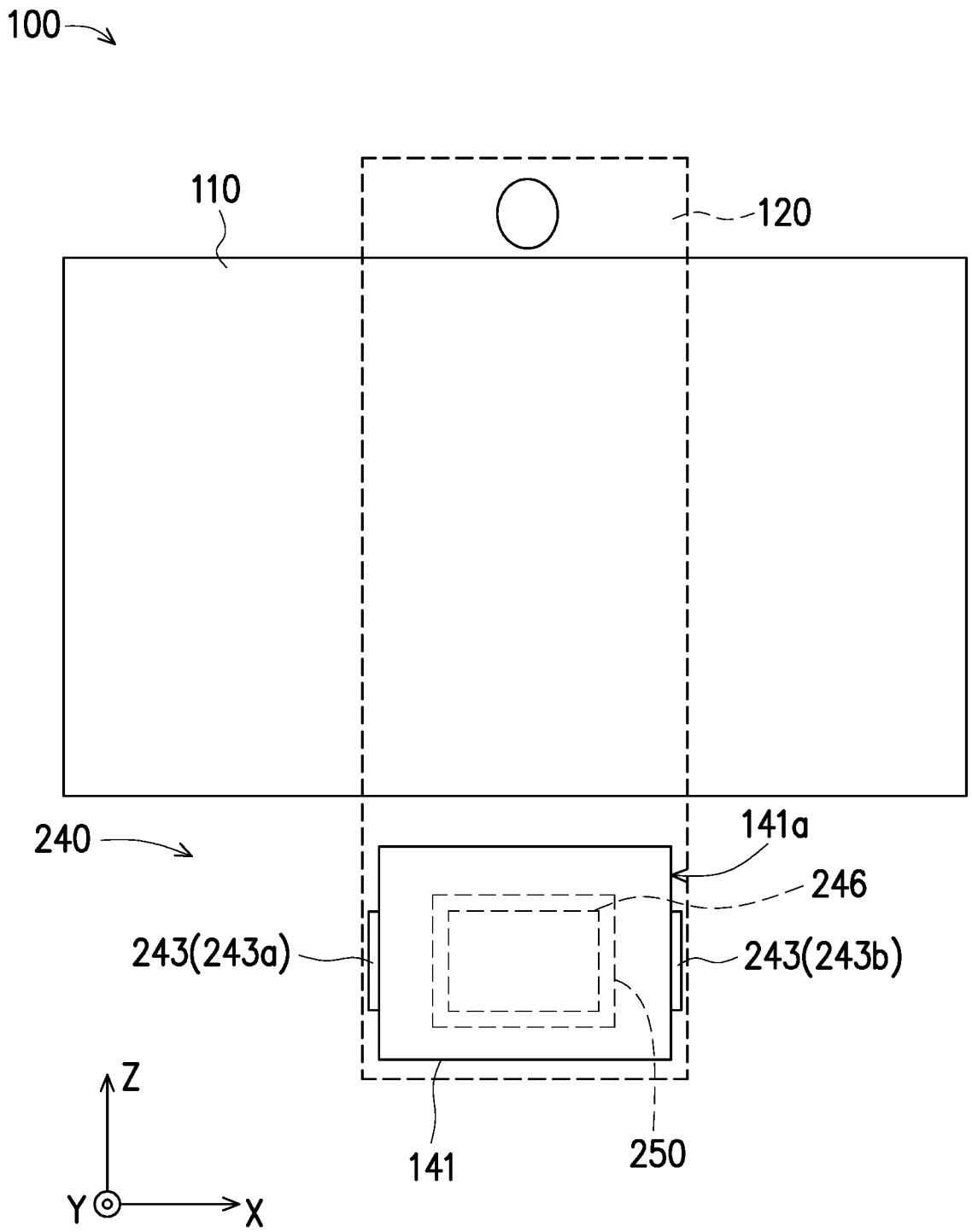
FIG. 4 is a schematic view illustrating an antenna assembly with two antennas according to a second embodiment of the disclosure.

In the second embodiment, one antenna assembly 240 may be equipped with two antennas 243, as indicated in FIG. 4.

For conciseness of the description and the drawings, the same description as provided in the first embodiment in which only one antenna is provided will not be repeated, the way to arrange the same or similar elements in the drawings are drawn in the same or similar manner, and the same or similar reference numbers are used for readers to understand easily.

With reference to FIG. 2 and FIG. 4, an opening 141*a* is formed at two opposite sides of the metal frame 141, the two antennas 243 are disposed at the corresponding plastic sheet 142, respectively, and the two plastic sheets 142 are embedded in the opening 141*a*. The distance between the two antennas 143 may be within a range from 100 mm to 140 mm.

In the present embodiment, a length of one of the antennas 243 may be within a range from 160 mm to 200 mm, and a length of the other antenna 243 may be within a range from 230 mm to 290 mm.

The following explanation is provided, given that a pair of antennas 243 contains a main antenna 243*a* and an auxiliary antenna 243*b*.

In the present embodiment, the structure of the antennas 243*a* and 243*b* is the same as the structure of the antenna 143 provided in the first embodiment, and the reference numbers used in the first embodiments will also be used hereinafter.

With reference to FIG. 3A, FIG. 3B, and FIG. 4, the size of the antenna main board 1431 may be 45 mm×10 mm×0.2 mm. Signals are transmitted to the point A1 of the first antenna pattern 1432 of the double-sided antenna D through the feed end F of the antenna main board 1431, which further allows the first antenna pattern 1432 to be electrically connected to the positive signal end of the coaxial transmission line 144.

When the coaxial transmission line 144 transmits an electric signal to the second antenna pattern 1433 of the double-sided antenna D through its positive signal end, the electric signal is further transmitted to the first antenna pattern 1432 through the conductive hole (not shown), and the first antenna pattern 1432 and the second antenna pattern 1433 are resonated to generate the antenna frequency bands of WiFi 2.4G and WiFi 5G.

To reduce the interference of the radiation from the two antennas 243, the antenna assembly 240 may further include a blocking member 246 arranged in the metal frame 141 and located between the two antennas 243, wherein the blocking member 246 may be a metal element, e.g., a metal board or sheet.

What is more, the blocking member 246 may also be one element in a functional unit 250. Here, the functional unit 250 may be a speaker, and the blocking member 246 is a metal element disposed in the speaker. Through the arrangement of the blocking member 246 between the two antennas 243, the blocking member 246 is able to produce favorable blocking effects and avoid noise caused by the mutual influence of the radiation ranges of the two antennas 243.

Figure 5:
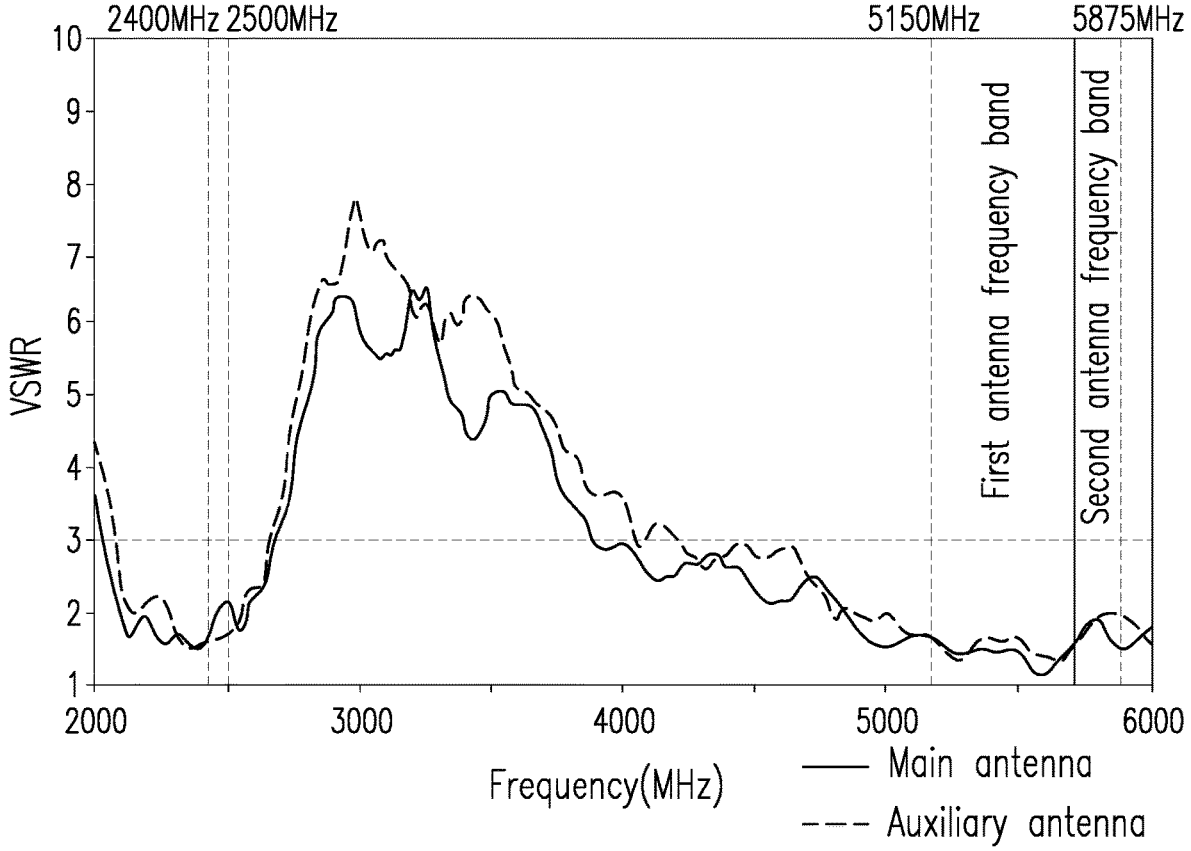
FIG. 5 is a schematic view illustrating a voltage standing wave ratio (VSWR) of two antennas.

FIG. 5 is a schematic view illustrating a voltage standing wave ratio (VSWR) of two antennas. As shown in FIG. 5, the VSWR of both antennas 243 can be less than 3.

Figure 6:
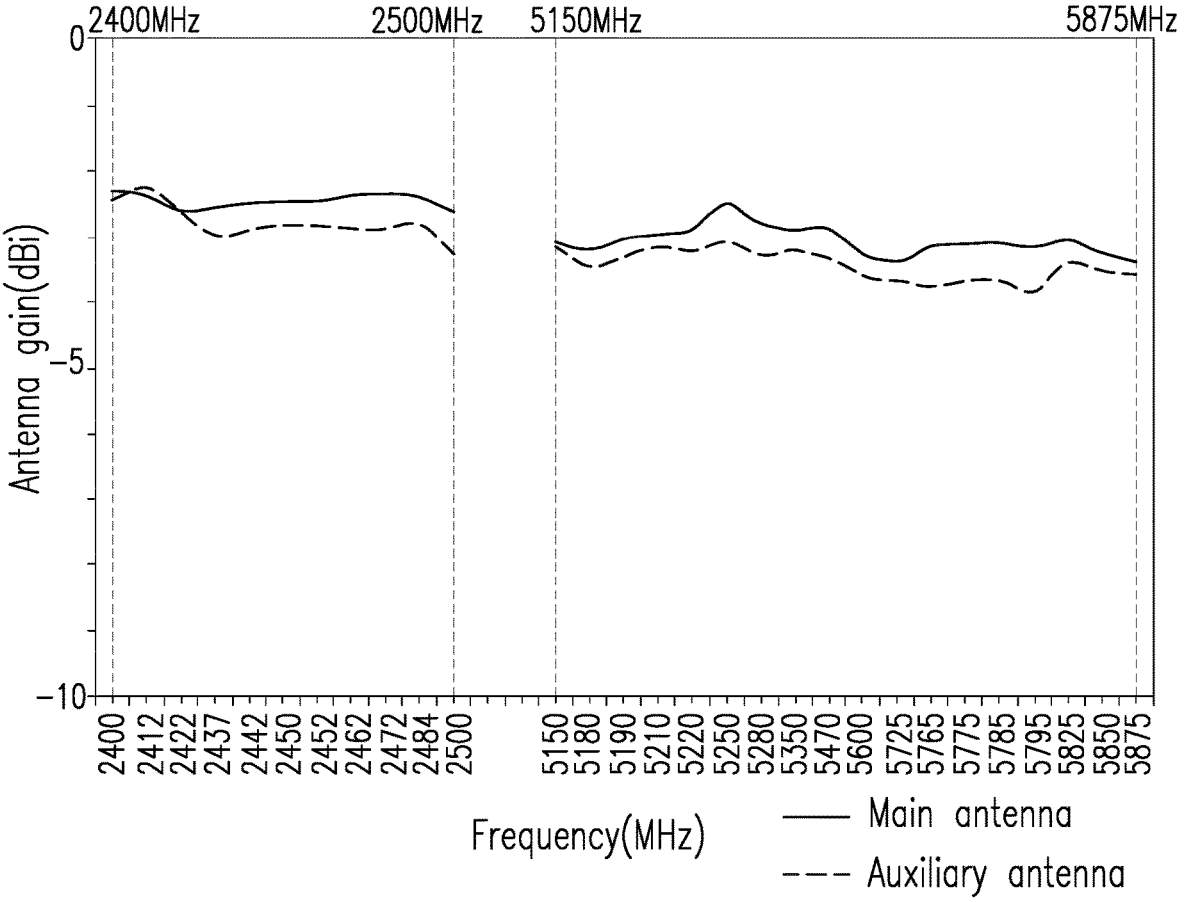
FIG. 6 is a schematic view illustrating the efficiency of two antennas.

FIG. 6 is a schematic view illustrating the efficiency of two antennas. With reference to FIG. 6, under the aforesaid structure, the antenna efficiency of the auxiliary antenna 243*b* (WiFi 5G) provided in the present embodiment is within a range from −3.8 dBi to −2.5 dBi, and the antenna efficiency of the main antenna 243*a* (WiFi 2.4G) is within a range from −3.0 dBi to −2.3 dBi. The antenna efficiency of both antennas 243 is greater than −4.0 dBi and is favorable.

Figure 7:
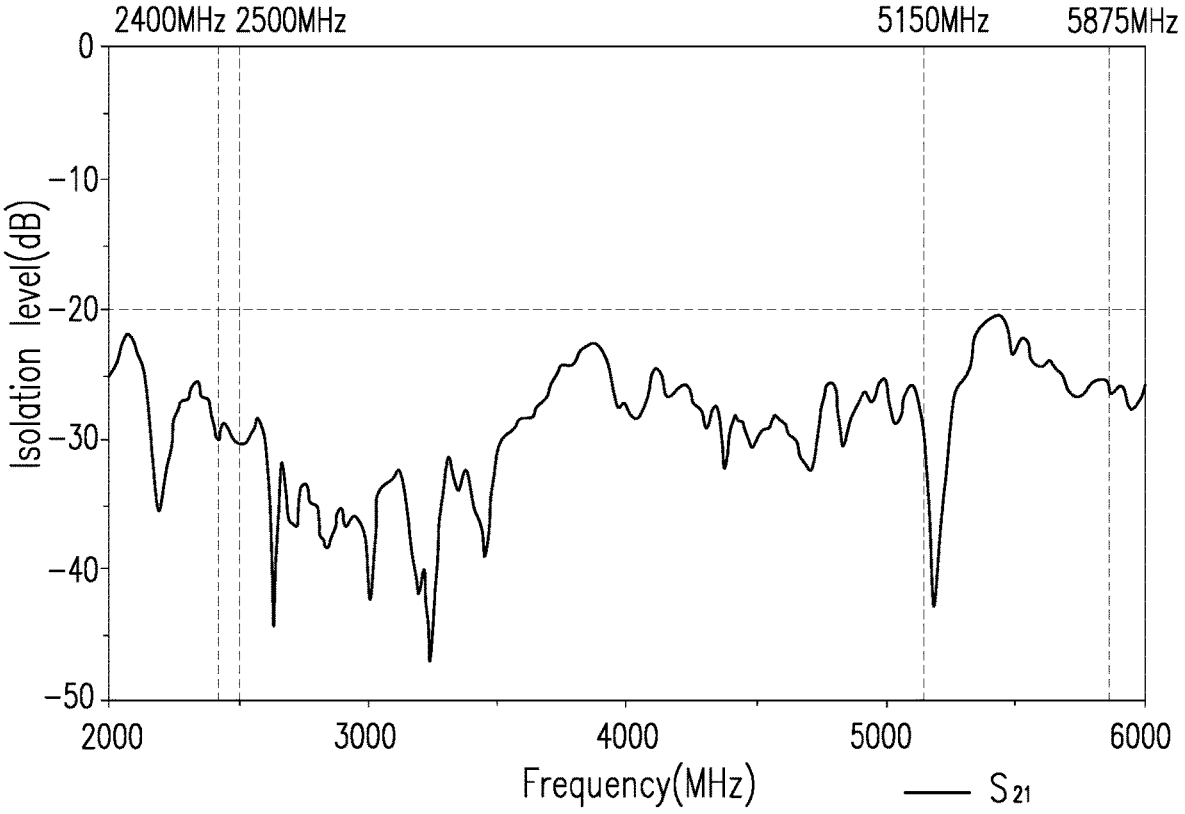
FIG. 7 is a schematic view illustrating a relationship between an isolation level and a frequency of an antenna.

Besides, the two antennas 243 are arranged at two sides of the metal foothold 120, a relative distance between the two antennas 243 is greater than 100 mm. The two antennas 243 are blocked by the blocking member 246. Hence, no matter whether the two antennas 243 are WiFi 2.4G antennas or WiFi 5G antennas, the isolation level between the two antennas 243 is lower than −20 dB, as shown in FIG. 7.

Figure 8:
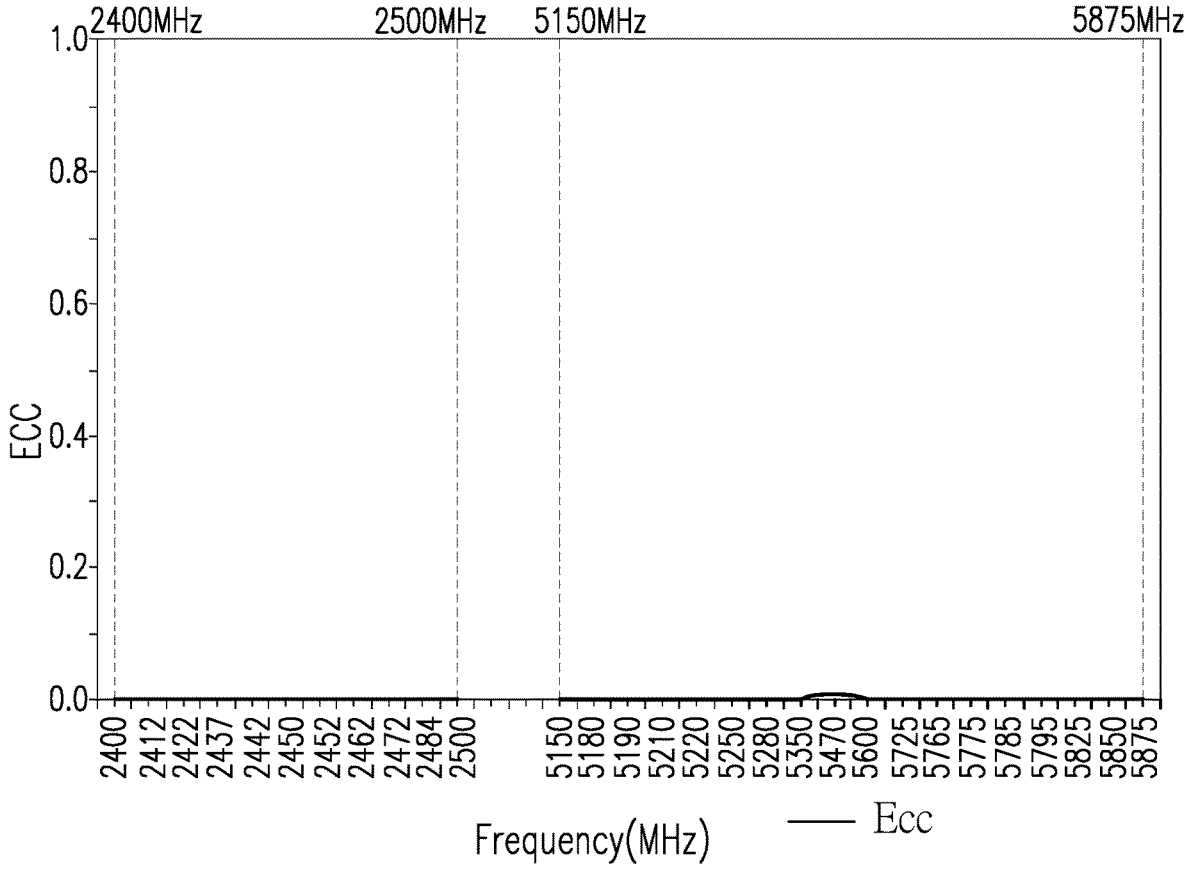
FIG. 8 is a schematic view illustrating a relationship between an envelope correlation coefficient (ECC) and a frequency.
Figure 9A:
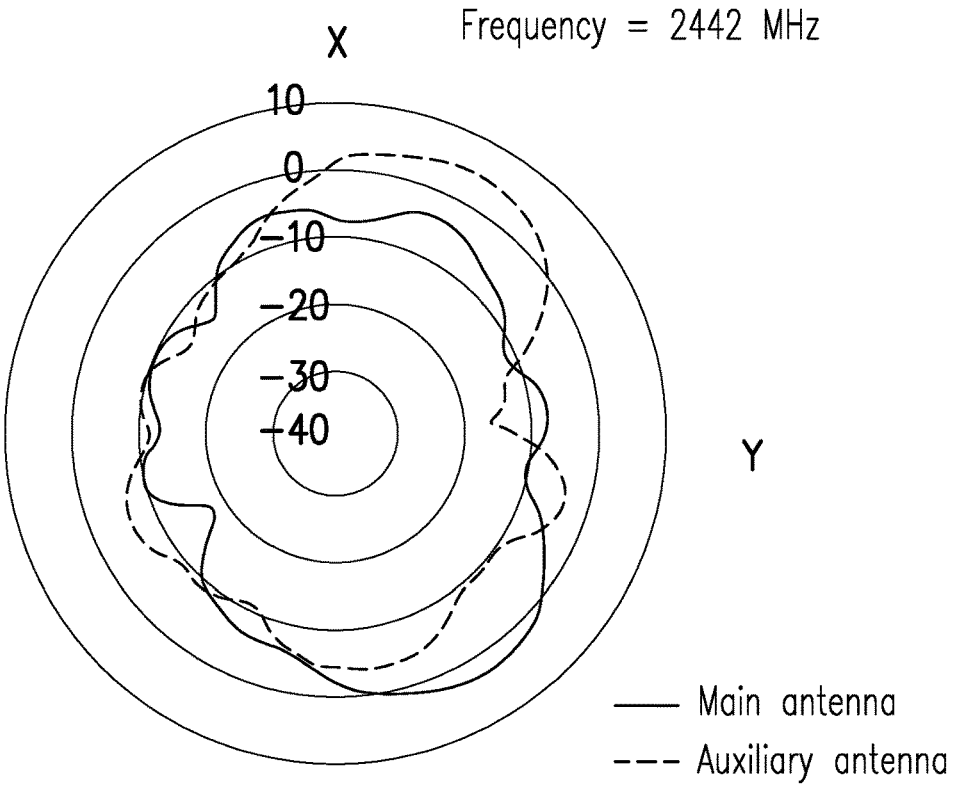
FIG. 9A and FIG. 9B illustrate a radiation pattern of an antenna on an x-y plane.
Figure 9B:
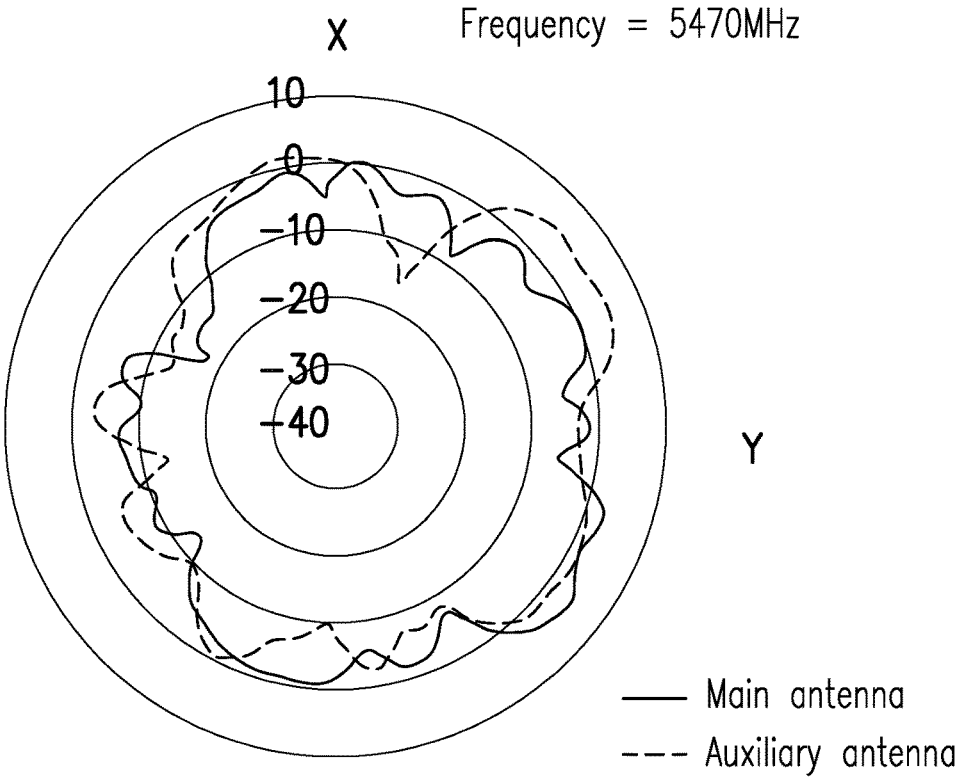

FIG. 8 is a schematic view illustrating a relationship between an envelope correlation coefficient (ECC) and a frequency, and FIG. 9A and FIG. 9B illustrate a radiation pattern of an antenna at an x-y plane. It can be observed from these drawings that the mutual influence on the two antennas 243 is not significant, and the ECC of each antenna 243 is equal to or less than 0.1. In the WiFi 2.4G frequency band, the radiation pattern of the main antenna 243*a* in a −x direction and the radiation pattern of the auxiliary antenna 243*b* in an x direction each have greater performance.

To sum up, in the electronic device provided in one or more embodiments of the disclosure, the antenna assembly can be an individual element, and the location where the antenna assembly is combined with other elements of the electronic device can be adjusted according to actual demands.

Besides, the metal frame and the metal foothold of the antenna assembly are integrated; hence, the display screen has extra spaces for other applications, so as to reduce the volume of the display screen occupied by the antenna.

Moreover, the antenna assembly is disposed at the metal foothold and integrated with the functional unit, whereby the space occupied by the metal foothold can be effectively utilized, and the isolation level between the two antennas can be improved by the blocking element arranged in the functional unit.

Further, the transmission lines of the two antennas are respectively routed at both sides and are not overlapped, thus leading no mutual influence.

Although the disclosure has provided the above-mentioned embodiments, it will be apparent to one of ordinary skill in the art that modifications to the described embodiments may be made without departing from the spirit of the invention. Accordingly, the protection scope will be defined by the attached claims and not by the above detailed descriptions.

What is claimed is:

1. An electronic device, comprising:

a display screen;

a metal foothold, the display screen being installed at the metal foothold;

a motherboard, disposed at the metal foothold, the display screen and the motherboard being located at two opposite surfaces of the metal foothold;

an antenna assembly, disposed at the metal foothold and electrically connected to the motherboard, the antenna assembly comprising:

a metal frame, disposed at the metal foothold, at least one side of the metal frame comprising an opening;

a plastic sheet, embedded in the opening;

at least one antenna, comprising:

an antenna main board, disposed at the plastic sheet and comprising a first surface, a second surface, and a conductive hole;

a double-sided antenna, comprising a first antenna pattern and a second antenna pattern, wherein the first antenna pattern and the second antenna pattern are disposed at the first surface and the second surface of the antenna main board, respectively, the second antenna pattern comprises a feed end and a ground end, and a signal transmitted through the feed end is conducted to the first antenna pattern through the conductive hole; and a conductive sheet, connected to the ground end and lapped over the metal frame.

2. The electronic device according to claim 1, wherein the first antenna pattern comprises a first radiation portion and a second radiation portion, a first groove is located between the first radiation portion and the second radiation portion, and the first radiation portion, the second radiation portion, and the metal frame are resonated to generate a first antenna frequency band.

3. The electronic device according to claim 2, wherein an impedance matching bandwidth of the first antenna frequency band is adjusted by adjusting a size of the first groove.

4. The electronic device according to claim 2, wherein the first radiation portion comprises a first portion and a second portion connected together, the second radiation portion comprises a third portion and a fourth portion connected together, the second portion is connected to the third portion, and the first groove is formed between the fourth portion and the first portion.

5. The electronic device according to claim 4, wherein a location of a resonance frequency of the first antenna frequency band is changed by adjusting a width of the second portion or a length of the first portion.

6. The electronic device according to claim 4, wherein the second portion, the third portion, and the metal frame are resonated to generate a second antenna frequency band.

7. The electronic device according to claim 6, wherein a location of a resonance frequency of the second antenna frequency band is adjusted by adjusting a width of the second portion.

8. The electronic device according to claim 4, wherein the first antenna pattern further comprises a third radiation portion, wherein a second groove is located between the first radiation portion and the third radiation portion, and the second portion, the third portion, the third radiation portion, and the metal frame are resonated to generate a third antenna frequency band.

9. The electronic device according to claim 8, wherein an impedance matching bandwidth of the third antenna frequency band is changed by adjusting a size of the second groove, and a location of a resonance frequency of the third antenna frequency band is changed by adjusting a width of the third portion.

10. The electronic device according to claim 1, further comprising a blocking member, wherein the number of the at least one antenna is configured to be plural, and the blocking member is disposed in the metal frame and located between the antennas.

11. The electronic device according to claim 1, wherein the metal foothold and the metal frame are integrally formed.

12. An antenna assembly, comprising:

a metal frame, at least one side of the metal frame comprising an opening;

a plastic sheet, embedded in the opening;

at least one antenna, comprising:

an antenna main board, disposed at the plastic sheet and having a first surface, a second surface, and a conductive hole;

a double-sided antenna, comprising a first antenna pattern and a second antenna pattern, wherein the first antenna pattern and the second antenna pattern are disposed at the first surface and the second surface of the antenna main board, respectively, the second antenna pattern comprises a feed end and a ground end, and a signal transmitted through the feed end is conducted to the first antenna pattern through the conductive hole; and a conductive sheet, connected to the ground end and lapped over the metal frame.

13. The antenna assembly according to claim 12, wherein the first antenna pattern comprises a first radiation portion and a second radiation portion, a first groove is located between the first radiation portion and the second radiation portion, and the first radiation portion, the second radiation portion, and the metal frame are resonated to generate a first antenna frequency band.

14. The antenna assembly according to claim 13, wherein an impedance matching bandwidth of the first antenna frequency band is adjusted by adjusting a size of the first groove.

15. The antenna assembly according to claim 13, wherein the first radiation portion comprises a first portion and a second portion connected together, the second radiation portion comprises a third portion and a fourth portion connected together, the second portion is connected to the third portion, and the first groove is formed between the fourth portion and the first portion.

16. The antenna assembly according to claim 15, wherein a location of a resonance frequency of the first antenna frequency band is changed by adjusting a width of the second portion or a length of the first portion.

17. The antenna assembly according to claim 15, wherein the second portion, the third portion, and the metal frame are resonated to generate a second antenna frequency band.

18. The antenna assembly according to claim 17, wherein a location of a resonance frequency of the second antenna frequency band is adjusted by adjusting a width of the second portion.

19. The antenna assembly according to claim 15, wherein the first antenna pattern further comprises a third radiation portion, wherein a second groove is located between the first radiation portion and the third radiation portion, and the second portion, the third portion, the third radiation portion, and the metal frame are resonated to generate a third antenna frequency band.

20. The antenna assembly according to claim 19, wherein an impedance matching bandwidth of the third antenna frequency band is changed by adjusting a size of the second groove, and a location of a resonance frequency of the third antenna frequency band is changed by adjusting a width of the third portion.

* * * * *